US011311786B1

(12) United States Patent
Willardson et al.

(10) Patent No.: US 11,311,786 B1
(45) Date of Patent: Apr. 26, 2022

(54) BASEBALL SWING TRAINING APPARATUS

(71) Applicants: David K Willardson, Katy, TX (US); Andrew Keith Willardson, San Luis Obispo, CA (US)

(72) Inventors: David K Willardson, Katy, TX (US); Andrew Keith Willardson, San Luis Obispo, CA (US)

( * ) Notice: Subject to any disclaimer, the term of this patent is extended or adjusted under 35 U.S.C. 154(b) by 68 days.

(21) Appl. No.: 17/086,843

(22) Filed: Nov. 2, 2020

(51) Int. Cl.
*A63B 69/00* (2006.01)
*A63B 24/00* (2006.01)

(52) U.S. Cl.
CPC ..... *A63B 69/0002* (2013.01); *A63B 24/0021* (2013.01); *A63B 69/0075* (2013.01); *A63B 2024/0031* (2013.01); *A63B 2069/0008* (2013.01); *A63B 2220/16* (2013.01); *A63B 2220/805* (2013.01); *A63B 2220/833* (2013.01); *A63B 2225/09* (2013.01)

(58) Field of Classification Search
CPC ..... A63B 69/0002; A63B 24/0021; A63B 69/0075; A63B 2024/0031; A63B 2069/0008; A63B 2220/16; A63B 2220/805; A63B 2220/833; A63B 2225/09
USPC ..... 473/417, 422, 451, 453
See application file for complete search history.

(56) References Cited

U.S. PATENT DOCUMENTS 3,439,916 A * 4/1969 Kopp ..... A63B 69/0075 473/419
5,156,402 A * 10/1992 Hart ..... A63B 69/0024 473/453
5,478,070 A * 12/1995 Morrison ..... A63B 69/0075 473/453
5,897,444 A * 4/1999 Hellyer ..... A63B 69/0075 473/417
6,461,255 B1 * 10/2002 Smith ..... A63B 69/0002 473/461
7,517,290 B1 * 4/2009 Springer ..... A63B 69/0002 473/428
9,061,190 B2 * 6/2015 Willardson ..... A63B 69/0075 473/417
9,375,622 B2 * 6/2016 Bond ..... A63B 69/0002 473/417
9,623,308 B2 * 4/2017 Bourgeois ..... A63B 69/0002 473/453

(Continued)

*Primary Examiner* — Mitra Aryanpour
(74) *Attorney, Agent, or Firm* — Gulf Coast Intellectual Property Group

(57) ABSTRACT

A baseball swing training apparatus that is configured to teach a player an optimal combination of three independent swing path angles wherein the apparatus further provides training for the three swing path angles for balls in alternate locations within a batter strike zone. The present invention includes a base platform that has four wheel assemblies operable to provide omnidirectional movement of the base platform. Secured to the upper surface of the base platform is the lift assembly. The lift assembly includes three arm members that are independently movable with separate motor and gear assemblies. A ball retention member is secured to the lift assembly wherein a swing path angle adjustment assembly is operably intermediate the ball retention assembly and the lift assembly. The swing path angle adjustment assembly includes a first, second and third axis movement assemblies each being independently adjustable.

20 Claims, 4 Drawing Sheets

(56) References Cited

U.S. PATENT DOCUMENTS

| | | | | |
|---|---|---|---|---|
| 9,914,034 | B2 * | 3/2018 | Lee | A63B 69/0091<br>473/417 |
| 10,245,493 | B2 * | 4/2019 | Beedle | A63B 69/0075<br>473/417 |
| 10,639,533 | B2 * | 5/2020 | LoDuca | A63B 69/0002<br>473/417 |
| 10,729,961 | B2 * | 8/2020 | Ohle | A63B 69/002<br>473/438 |
| 10,835,798 | B2 * | 11/2020 | Corniel | A63B 71/023<br>473/417 |
| 11,247,111 | B2 * | 2/2022 | Harvey, Jr. | A63B 69/40<br>473/451 |
| 2003/0220177 | A1 * | 11/2003 | Orlando | A63B 21/04<br>482/148 |
| 2006/0240917 | A1 * | 10/2006 | Campbell | A63B 69/0002<br>473/453 |
| 2007/0129182 | A1 * | 6/2007 | Taylor | A63B 69/0002<br>473/422 |

* cited by examiner

BASEBALL SWING TRAINING APPARATUS

FIELD OF THE INVENTION

The present invention relates generally to sports training equipment, more specifically but not by way of limitation, a baseball swing training apparatus that is configured to provide ball position training and guidance on three distinct swing path angles so as to optimize a players ability to successfully contact baseballs presented in alternate pitch locations.

BACKGROUND

In sports training such as but not limited to baseball swing training, there has been a trend over the past few years to incorporate data into baseball training so that players can train different aspects of hitting based on data collected from the mechanics of the best hitters in the sport. Research of both data and video of the best performing Major League Baseball hitters indicate the players utilize different combinations of three swing path angles depending on the location of the incoming pitch. The three angles include a first swing path angle known as the vertical swing angle wherein the vertical swing angle is defined herein as the vertical angle of the swing plane as viewed from center field. The second swing path angle is referred to as the explicit loft angle being defined herein as the tilt in the swing plane from catcher to pitcher as viewed from a face-on bat direction. The third swing path angle is known as the horizontal bat angle, which is defined herein as the horizontal angle of the bat as it travels along the swing path created by the prior two angles.

Data and video of the most successful hitters indicate that they are using larger amounts of vertical swing angle and horizontal swing angle for low and inside pitches. Alternatively, successful hitters have a swing path wherein the explicit loft is greater for higher and outside pitches. While some of the current technology places a baseball at different locations in the strike zone to teach different swing path angle combinations for different pitch locations, these existing devices most often require manual adjustment of the device and further can be deficient in teaching all of the three available swing angles. Existing swing training devices provide no accommodation for efficient adjustment from player to player and setup for a different player is time consuming and cumbersome.

It is intended within the scope of the present invention to provide a swing path training apparatus for teaching three distinct swing path angles for a baseball swing wherein the apparatus of the present invention is further operated through automation so as to accommodate multiple players more easily.

SUMMARY OF THE INVENTION

It is the object of the present invention to provide a baseball swing path training apparatus that is operable to train a hitter on three different swing path angles wherein the device is configured to provide a baseball at a plurality of locations within a strike zone of a batter.

Another object of the present invention is to provide a swing training apparatus for sports such as but not limited to baseball and softball wherein the apparatus of the present invention includes a base platform member that is movably mounted on wheels.

A further object of the present invention is to provide a baseball swing path training apparatus that is operable to train a hitter on three different swing path angles wherein the apparatus further includes a lift assembly that is configured to vertically adjust the ball retention assembly.

Still another object of the present invention is to provide a swing training apparatus for sports such as but not limited to baseball and softball wherein the ball retention assembly is movable on an X, Y and Z axis.

An additional object of the present invention is to provide a baseball swing path training apparatus that is operable to train a hitter on three different swing path angles wherein the ball retention assembly is configured to releasably secure a ball and make available for contact by a hitter.

Yet a further object of the present invention is to provide a swing training apparatus for sports such as but not limited to baseball and softball wherein the present invention includes a speed detection member configured to measure bat speed during the swing execution.

Another object of the present invention is to provide a baseball swing path training apparatus that is operable to train a hitter on three different swing path angles that further includes a ball flight tracking member that is operable to provide the launch and spray angle of a contacted ball.

An alternate object of the present invention is to provide a swing training apparatus for sports such as but not limited to baseball and softball wherein the apparatus of the present invention further includes a controller that is communicably coupled with a remote computing device to facilitate operation thereof.

An alternative objective of the present invention is to provide a baseball swing path training apparatus that is operable to train a hitter on three different swing path angles wherein the ball retention assembly is operably controlled with three separate motor and gear assemblies.

Another object of the present invention is to provide a swing training apparatus for sports such as but not limited to baseball and softball wherein the apparatus of the present invention wherein the lift assembly includes a plurality of pivotally coupled arm members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
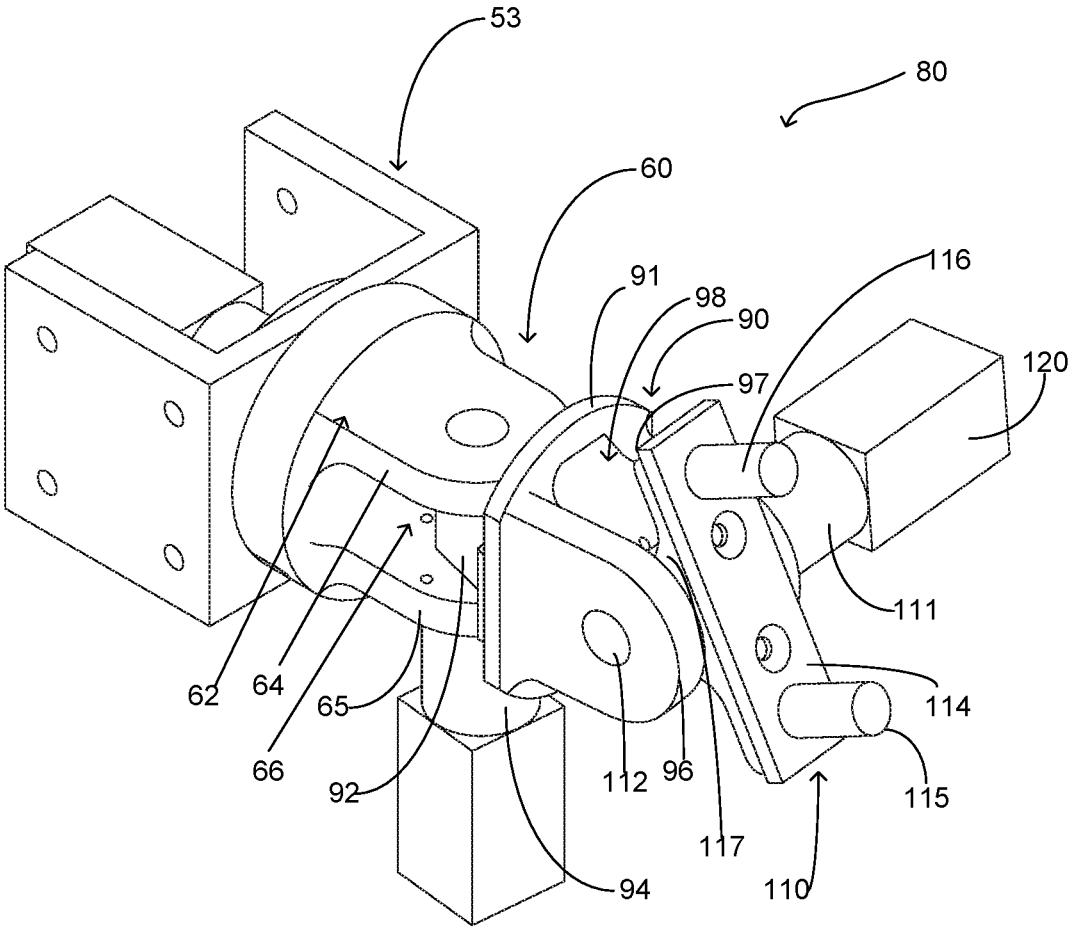
FIG. 1 is a detailed view of the swing path angle adjustment assembly.
Figure 2:
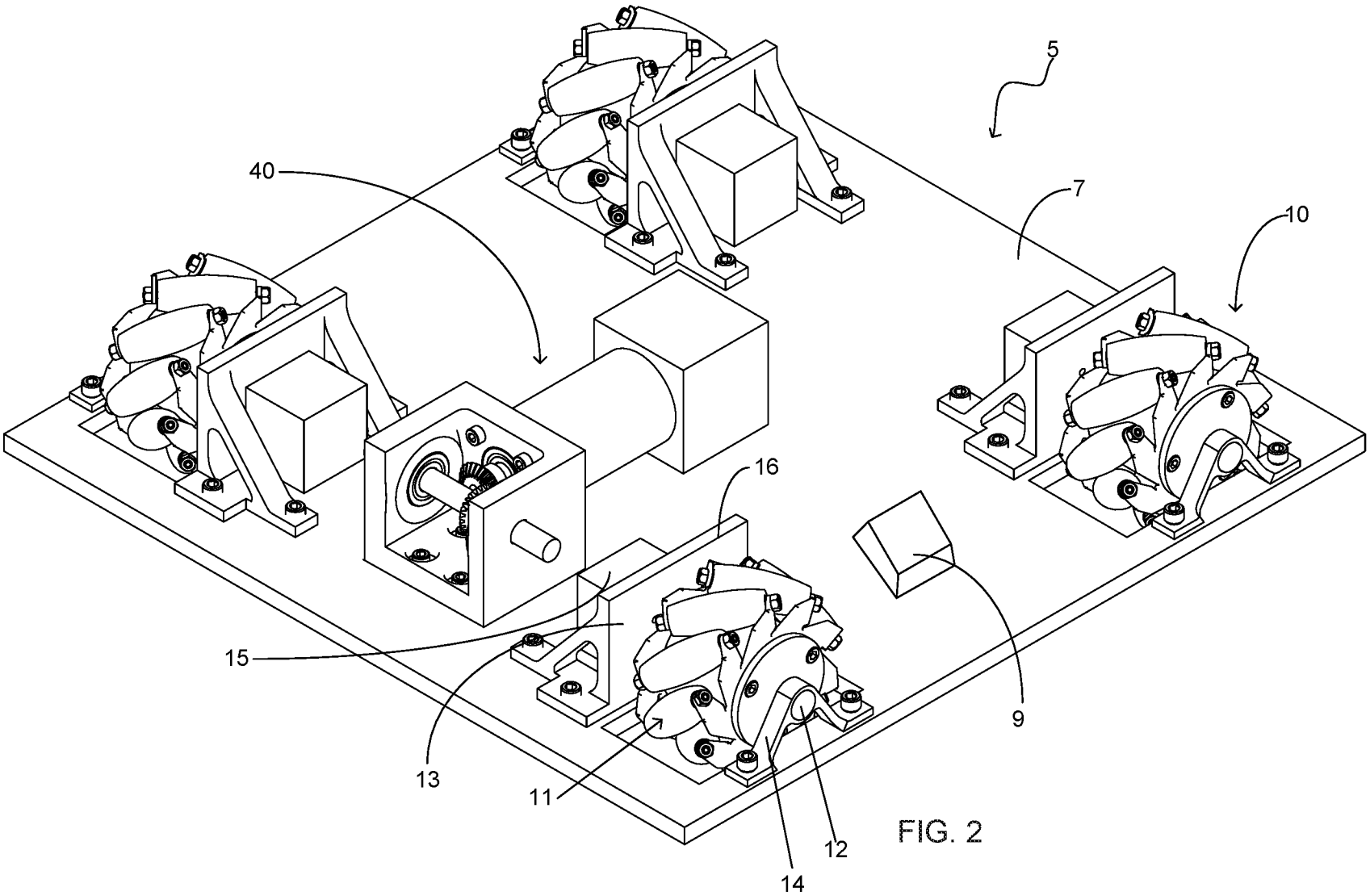
FIG. 2 is a detailed view of the base platform member of the present invention.
Figure 3:
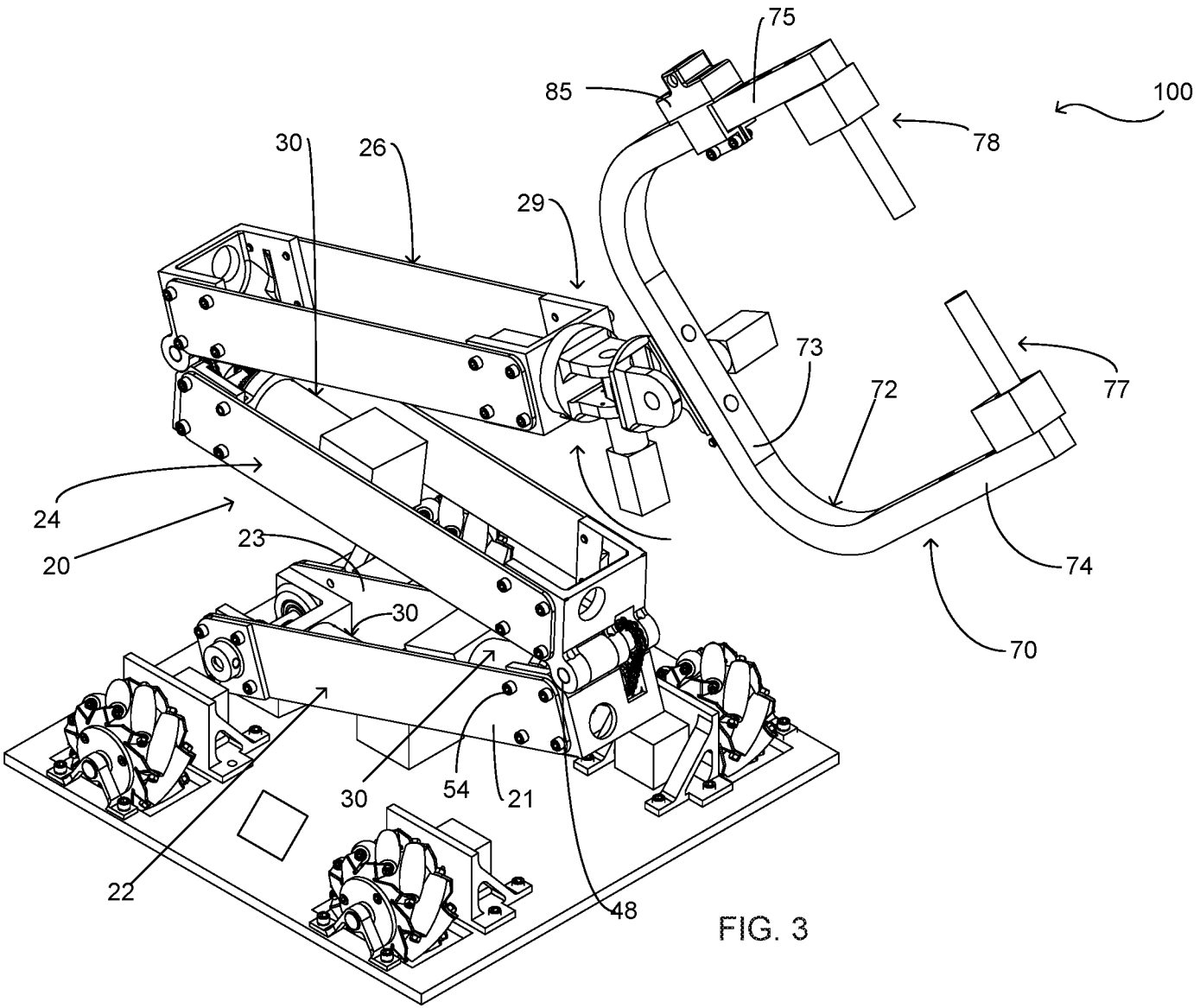
FIG. 3 is a perspective view of a preferred embodiment of the present invention.
Figure 4:
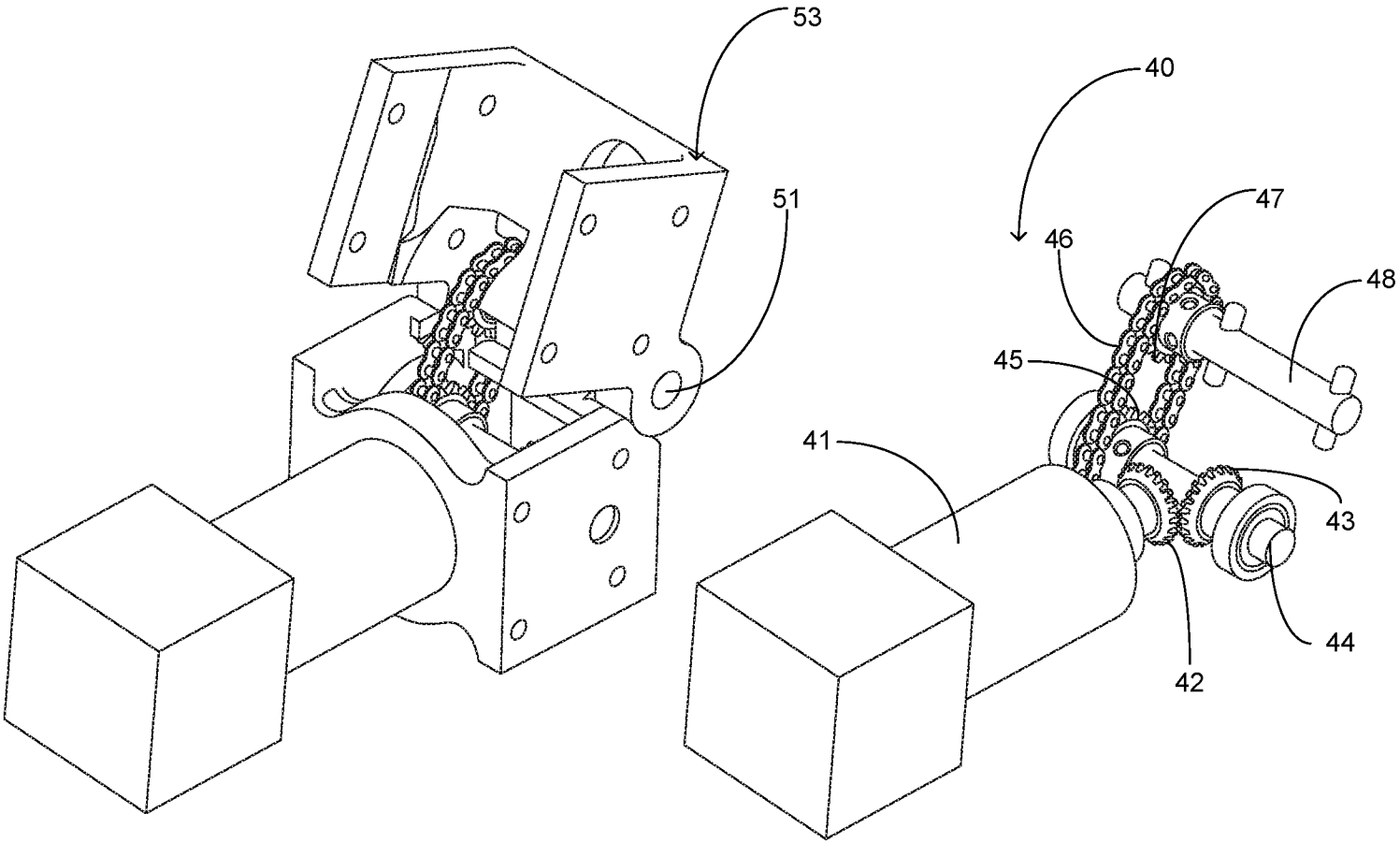
FIG. 4 is a detailed view of a motor and gear assembly for the arm members of the lift assembly.

References now to the drawings submitted herewith, wherein various elements depicted therein are not necessarily drawn to scale and wherein through the views and figures like elements are referenced with identical reference numerals, there is illustrated a baseball swing training apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Drawings submitted as a part hereof, the baseball swing training apparatus 100 includes a base platform member 5 that is configured to be superposed the ground and provide the necessary structural and stability support when a user is engaged with the baseball swing training apparatus 100. The base platform member 5 includes a base plate 7 that is manufactured from a durable rigid material such as but not limited to metal. The base plate 7 in a preferred embodiment is square in shape but it should be understood within the scope of the present invention that the base plate 7 could be provided in alternate shapes and sizes. The base plate 7 has a controller 9 secured thereto. The controller 9 is configured to provide an operational interface and control of the baseball swing training apparatus 100 wherein the controller 9 includes the necessary electronics to receive, store, transmit and manipulate data. The controller 9 is communicably coupled to a remote computing device (not illustrated herein) wherein a user will engage a conventional software application in order to manipulate the position of the baseball swing training apparatus 100. It should be understood that housed within the controller 9 is a conventional power supply such as but not limited to a lithium ion battery.

The base platform member 5 is movable in an omnidirectional manner so as to provide the correct positioning of the ball retention assembly 70 as will be further described herein. Operably coupled to the base plate 7 are wheel assemblies 10. Each wheel assembly 10 is proximate a corner of the base plate 7 and includes a wheel member 11, shaft 12, first shaft support member 13, second shaft support member 14 and motor 15. The wheel member 11 in a preferred embodiment is a Mecanum wheel so as to provide the aforementioned omnidirectional movement. The wheel member 11 is rotatably mounted to the shaft 12. The shaft 12 is mounted intermediate the first shaft support member 13 and the second shaft support member 14. The first shaft support member 13 includes a guard plate member 16 having the shaft journaled therethrough and operably coupled to motor 15. Each wheel assembly 10 is communicably coupled to the controller 9 wherein the controller 9 provides independent control of each wheel assembly 10 and as such providing the desired omnidirectional movement of the base platform member 5. Each motor 15 will rotate the shafts 12 in an independent direction in order to effect the desired position of the baseball swing training apparatus 100. In use, the base platform member 5 movement is implemented to position the baseball swing training apparatus 100 adjacent to the baseball plate hitting area or batter's box in order to ensure the ball retention assembly 70 can then be moved to the desired position. While four wheel assemblies 10 are illustrated herein, it is contemplated within the scope of the present invention that more or less than four wheel assemblies 10 could be employed to achieve the discussed objective.

The baseball swing training apparatus 100 includes a lift assembly 20 wherein the lift assembly 20 is operably coupled between the base platform member 5 and the ball retention assembly 70. The lift assembly 20 is configured to provide vertical movement of the ball retention assembly 70. The lift assembly 20 is comprised of three arm members 22, 24, 26 wherein each of the three arm members are pivotally coupled. Each of the three arm members 22,24,26 are operably controlled with an independent motor and gear assembly 30 as will be further discussed herein. The first arm member 22 includes a first sidewall 21 and a second sidewall 23. A void 25 exists between the first sidewall 21 and second sidewall 23 wherein the void 25 functions to provide space for the motor and gear assembly 30 thus allowing a position wherein the three arm members 22,24, 26 can be placed in a vertically stacked and adjacent position.

A first arm motor and gear assembly 40 is secured to the base plate 7 and is operably coupled with the first arm member 22. The first arm motor and gear assembly 40 includes a motor 41, first gear 42, second gear 43, shaft 44, first sprocket 45, chain 46, second sprocket 47 and pin 48. The motor 41 rotatably drives first gear 42 which is operably coupled to second gear 43 wherein the second gear 43 is surroundabaly secured to shaft 44. Rotational movement of shaft 44 elicits rotational movement of the first sprocket 45 that is secured thereto. A chain 46 is operably coupled intermediate the first sprocket 45 and second sprocket 47. The chain 46 provides operational rotation of the second sprocket 47 and as such the pin 48. Pin 48 is operably coupled with passage 51 that is formed in the arm bracket member 53. The arm bracket member 53 is present at each end of the three arm members 22,24,26. Arm bracket member 53 is square U-shaped having apertures configured to receive fasteners 54 that secure the sidewalls 21, 23 thereto. Each of the three arm members 22,24,26 have an independent motor and gear assembly 30 which is operable to provide independent movement of each of the three arm members 22,24,26. While the lift assembly 20 is illustrated herein as having three arm members 22,24,26 being independently movable with three motor and gear assemblies 30 it should be understood within the scope of the present invention that the lift assembly 20 could be constructed in alternate manners using various elements to provide a vertical movement of the ball retention assembly 70.

The ball retention assembly 70 is movably secured to the lift assembly 20 via swing path angle adjustment assembly 80 as will be further discussed herein. The ball retention assembly 70 includes main support bracket 72 that is U-shaped and is manufactured from a suitable rigid material such as but not limited to metal. The main support bracket 72 includes a rear portion 73, a lower arm portion 74 and an upper arm portion 75 that are contiguously formed. The main support bracket 72 is manufactured so as to have a suitable distance intermediate the lower arm portion 74 and upper arm portion 75 to avoid contacting a bat being swung therethrough during use of the baseball swing training apparatus 100. Secured to each end of the lower arm portion 74 and upper arm portion 75 are ball securing members 77,78. The ball securing members 77,78 are perpendicular to the lower arm portion 74 and upper arm portion 75 respectively and are manufactured from a resilient material such as but not limited to rubber. The ball securing members 77,78 are operable to releasable secure a baseball therein and retain in position to allow a user of the baseball swing training apparatus 100 to contact with a bat.

A ball flight tracking member 85 is secured to the upper arm portion 75. The ball flight tracking member 85 is communicably coupled to the controller 9 and includes the necessary electronics to record both the launch angle and spray angle of a baseball that has been hit from the ball securing members 77,78. Both the launch angle and spray angle of the baseball is transmitted to the controller 9 which is subsequently transmitted to a remote computing device for storage and display thereof. The ball flight tracking member 85 employs conventional laser and optical sensors to detect and measure the launch angle and spray angle of a baseball exiting the ball retention assembly 70. While the ball flight tracking member 85 is illustrated herein as being secured to the upper portion 75, it should be understood within the scope of the present invention that the ball flight tracking member 85 could be located in alternate positions and still achieve the desired objective.

As discussed herein, the baseball swing training apparatus 100 provides three distinct swing path angle adjustments in order to provide swing path training for a user of the baseball swing training apparatus 100. The swing path angle adjustment assembly 80 is secured to an arm bracket member 53 at the distal end of the third arm member 26. A first axis movement assembly 60 is rotatably secured to arm bracket member 53 at distal end 29 of the third arm member 26. The first axis movement assembly 60 includes motor 61 wherein the motor 61 is operably coupled to mount 62 and is configured to provide rotational movement thereof. Mount 62 includes a base plate 63 and an upper support member 64 and a lower support member 65 and further has a void 66 therebetween. The first axis movement assembly 60 is manufactured from a suitable material such as but not limited to metal. The base plate 63, upper support member 64 and lower support member 65 are contiguously formed utilizing suitable techniques. The first axis movement assembly 60 is operably coupled to the controller 9 wherein inputs received therefrom will provide rotational movement of thereof. The first axis movement assembly 60 provides control of the explicit swing path loft angle previously described herein. The explicit swing path loft angle is the tilt axis in the swing plane from catcher to pitcher as viewed from a face-on bat direction. The first axis movement assembly 60 will rotate to a different position to place the ball retention assembly 70 in the correct orientation for the ideal explicit swing path loft angle. The immediately aforementioned is executed based on where the ball location is within a conventional strike zone. By way of example but not limitation, a desired explicit swing path loft angle will be different for a high outside pitch versus a low inside pitch. The first axis movement assembly 60 will rotate to a different position for training different pitch locations. It should be understood that the baseball swing training apparatus 100 will manipulate the ball retention assembly 70 to place the baseball in alternate strike locations which includes proper adjustment of the swing path angle adjustment assembly 80 and all three angles controlled thereby.

Movably coupled to the first axis movement assembly 60 is the second axis movement assembly 90. The second axis movement assembly 90 includes a base member 91 being planar in manner having an arm member 92 secured thereto. Arm member 92 extends into void 66 and is movably coupled to motor assembly 94. Motor assembly 94 is operably coupled to controller 9 and will move the second axis movement assembly 90 to a desired location with respect to the first axis movement assembly 60 in a left-to-right pattern. The second axis movement assembly 90 further includes a first arm member 96 and a second arm member 97 extending outward from the base member 91. First arm member 96 and second arm member 97 are perpendicular to the base member 91 further being parallel and having a void 98 therebetween. The second axis movement assembly 90 sets the horizontal swing path bat angle. As previously described herein, the horizontal swing path bat angle is the horizontal angle of the bat as it travels along its swing path. The second axis movement assembly 90 will be moved to alternate positions based again on desired training for a ball at different locations in the strike zone.

The third axis movement assembly 110 is movably coupled to the second axis movement assembly 90. The third axis movement assembly includes a motor 111 operably coupled to a shaft 112. The third axis movement assembly 110 is operably coupled to controller 9 and will move to a desired position based on inputs therefrom. The third axis movement assembly 110 includes a base support member 114 and further having mounting pins 115,116 extending outward therefrom being perpendicular thereto. Mounting pins 115, 116 function to operably couple to the ball retention assembly 70. A rear extension member 117 extends outward from the base support member 114 opposite the mounting pins 115,116. The rear extension member 117 is operably coupled to shaft 112. The third axis movement assembly 110 is pivoted in an upwards-downwards direction so as to provide adjustment of the horizontal swing path bat angle. As has been discussed herein, the horizontal swing path bat angle is the horizontal angle of the bat as the bat travels along a swing path. The third axis movement member 110 is set to a different position based the pitch simulation location as has been previously discussed.

A bat speed detection member 120 is located adjacent to the ball retention assembly 70. The bat speed detection member 120 is operably coupled to the controller 9 and is configured to detect, measure and transmit the speed of the bat as it passes through the ball retention assembly 70. The speed is measure utilizing conventional sensors such as but not limited to optical sensors. Ensuing measurement of the bat speed, the bat speed detection member 120 transmits to the controller 9 which can additionally be then transmitted to a remote computing device for storage and analysis by a user of the baseball swing training apparatus 100.

While the first axis movement assembly 60, second axis movement assembly 90 and third axis movement assembly 110 have been illustrated and discussed herein in specific embodiments, it is contemplated within the scope of the present invention that the first axis movement assembly 60, second axis movement assembly 90 and third axis movement assembly 110 could be constructed in alternate manners and still achieve the desired objective herein. The baseball swing training apparatus 100 provides the ability to offer a ball position for a user to practice pitch locations in a plurality of locations in the strike zone through manipulation of the first axis movement assembly 60, second axis movement assembly 90 and third axis movement assembly 110 wherein the manipulation of the three axes lead to the ability to more successfully contact baseball pitched to various locations. It should be understood within the scope of the present invention that all of the motors incorporated into the present invention are conventional direct current electric motors.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A baseball swing training apparatus configured to provide training for a user to improve hitting baseballs at various locations within a strike zone wherein the baseball swing training apparatus comprises:

a base platform member, said base platform member being planar in manner and configured to be superposed a ground surface, said base platform member having an upper surface, said base platform member having at least one wheel assembly operably coupled thereto, said at least one wheel assembly configured to move said base platform member in an omnidirectional movement;

a controller, said controller having necessary electronics to receive, store, transmit and manipulate data, said controller further being communicably coupled to at least one remote computing device wherein the remote computing device provides an operational interface for operation of the controller;

a ball retention assembly, said ball retention assembly configured to releasably secure a baseball;

a lift assembly, said lift assembly operably coupled to said base platform member and said ball retention assembly, said lift assembly configured to provide vertical movement of said ball retention assembly; and a swing path angle adjustment assembly, said swing path angle adjustment assembly operably coupling said ball retention assembly to said lift assembly, said swing path angle adjustment assembly configured to provide independent manipulation of three separate swing path angles.

2. The baseball swing training apparatus as recited in claim 1, wherein said swing path angle adjustment assembly further includes a first axis movement assembly, said first axis movement assembly being rotatably mounted to said lift assembly distal to said base platform member, said first axis movement assembly operable to provide adjustment of a explicit swing path loft angle wherein said explicit swing path loft angle is a tilt in a swing plane of a bat from a perspective of a catcher to a pitcher of a baseball as viewed from a face-on bat direction.

3. The baseball swing training apparatus as recited in claim 2, wherein said swing path angle adjustment assembly further includes a second axis movement assembly, said second axis movement assembly being operably coupled to said first axis movement assembly, said second axis movement assembly operable to provide adjustment of a horizontal swing path bat angle wherein the horizontal swing path bat angle is a horizontal angle of a bat traveling through a swing path.

4. The baseball swing training apparatus as recited in claim 3, wherein said swing path angle adjustment assembly further includes a third axis movement assembly, said third axis movement assembly being operably coupled to said second axis movement assembly, said third axis movement assembly being independently movable, said third axis movement assembly operable to provide adjustment of a vertical swing path angle wherein the vertical swing path angle is a vertical angle of a swing plane as viewed from center field of a baseball field.

5. The baseball swing training apparatus as recited in claim 4, wherein said second axis movement assembly is operable to move in a left-right direction with respect to said first axis movement assembly.

6. The baseball swing training apparatus as recited in claim 5, wherein said third axis movement assembly is configured to move in an upwards-downwards direction with respect to said second axis movement assembly.

7. The baseball swing training apparatus as recited in claim 6, and further including a ball flight tracking member, wherein said ball flight tracking member is configured to measure, record and transmit a launch angle and a spray angle of a baseball as the baseball departs the baseball swing training apparatus.

8. A baseball swing path training apparatus that is operable to provide three distinct swing path training axes for a baseball swing wherein the baseball swing path training apparatus comprises:

a base member, said base member being formed from a base plate, said base plate being planar in manner and square in shape having four corners, said base plate having an upper surface, said base plate having a wheel assembly located proximate each corner thereof, said wheel assembly configured to move said base member in an omnidirectional movement;

a controller, said controller being mounted to the upper surface of said base plate, said controller having necessary electronics to receive, store, transmit and manipulate data, said controller further being communicably coupled to a remote computing device wherein the remote computing device provides an operational interface for operation of the baseball swing path training apparatus;

a ball retention assembly, said ball retention assembly being u-shaped, said ball retention assembly including a rear portion, a lower portion and an upper portion being contiguously formed, said ball retention assembly further including ball securing members being operably coupled to said lower portion and said upper portion of said ball retention assembly, said ball securing members configured to releasably secure a baseball therebetween;

a lift assembly, said lift assembly operably coupled to said base plate and said ball retention assembly, said lift assembly including a plurality of arm members, each of said plurality of arm members being pivotally coupled to each other at one end thereof, said plurality of arm members being independently movable, said lift assembly configured to provide vertical movement of said ball retention assembly; and a swing path angle adjustment assembly, said swing path angle adjustment assembly operably coupling said ball retention assembly to said lift assembly, said swing path angle adjustment assembly including a first axis movement assembly, a second axis movement assembly and a third axis movement assembly, said first axis movement assembly, said second axis movement assembly and said third axis movement assembly all being independently adjustable.

9. The baseball swing path training apparatus as recited in claim 8, wherein each of said plurality of arm members further include a motor and gear assembly being operable to independently move each of said plurality of arm members.

10. The baseball swing path training apparatus as recited in claim 9, wherein said first axis movement assembly being rotatably mounted to said lift assembly distal to said base platform member, said first axis movement assembly operable to provide adjustment of a explicit swing path loft angle, wherein said explicit swing path loft angle is a tilt in a swing plane of a bat from a perspective of a catcher to a pitcher of a baseball as viewed from a face-on bat direction.

11. The baseball swing path training apparatus as recited in claim 10, wherein said second axis movement assembly being operably coupled to said first axis movement assembly, said second axis movement assembly operable to provide adjustment of a horizontal swing path bat angle wherein the horizontal swing path bat angle is a horizontal angle of a bat traveling through a swing path.

12. The baseball swing path training apparatus as recited in claim 11, wherein said third axis movement assembly being operably coupled to said second axis movement assembly, said third axis movement assembly being independently movable, said third axis movement assembly operable to provide adjustment of a vertical swing path angle wherein the vertical swing path angle is a vertical angle of a swing plane as viewed from center field of a baseball field.

13. The baseball swing path training apparatus as recited in claim 12, and further including a bat speed detection member, said bat speed detection member configured to measure, record and transmit a speed of a bat passing through the ball retention member.

14. The baseball swing path training apparatus as recited in claim 13, and further including a ball flight tracking member, wherein said ball flight tracking member is configured to measure, record and transmit a launch angle and a spray angle of a baseball as the baseball departs the baseball swing training apparatus.

15. A baseball swing training apparatus operable to train a player on an optimal combination of three swing path angles for a baseball swing for baseballs located in alternate locations of a strike zone wherein the baseball swing training apparatus comprises:

a base member, said base member being formed from a base plate, said base plate being planar in manner and square in shape having four corners, said base plate having an upper surface, said base plate having four wheel assemblies wherein one of each of the four wheel assemblies is located proximate at each corner of the base plate, said four wheel assemblies configured to move said base member in an omnidirectional movement;

a controller, said controller being mounted to the upper surface of said base plate, said controller having necessary electronics to receive, store, transmit and manipulate data, said controller further being communicably coupled to a remote computing device wherein the remote computing device provides an operational interface for operation of the baseball swing path training apparatus;

a ball retention assembly, said ball retention assembly being u-shaped, said ball retention assembly including a rear portion, a lower portion and an upper portion being contiguously formed, said ball retention assembly further including ball securing members being operably coupled to said lower portion and said upper portion of said ball retention assembly, said ball securing members configured to releasably secure a baseball therebetween;

a lift assembly, said lift assembly operably coupled to said base plate and said ball retention assembly, said lift assembly including three arm members, said three arm members having a first end and a second end, said three arm members each having opposing sidewalls forming a void therebetween wherein the void extends intermediate the first end and second end of each of said three arm members, said three arm members being pivotally coupled to each other at one end thereof, said three arm members being independently movable wherein each of three arm members is operably controlled by a separate motor and gear assembly, said lift assembly configured to provide vertical movement of said ball retention assembly; and a swing path angle adjustment assembly, said swing path angle adjustment assembly operably coupling said ball retention assembly to said lift assembly, said swing path angle adjustment assembly including a first axis movement assembly, a second axis movement assembly and a third axis movement assembly, said first axis movement assembly, said second axis movement assembly and said third axis movement assembly all being independently adjustable, wherein a portion of said first axis movement assembly is rotatably coupled to one of said three arm members of said lift assembly that is distal to said base plate, said first axis movement assembly having a motor assembly, said second axis movement assembly being operably coupled to said first axis movement assembly and having a motor assembly operably coupled thereto, said third axis movement assembly being operably coupled to said second axis movement assembly and wherein said third axis movement assembly is moved in an upwards-downwards direction with an independent motor assembly.

16. The baseball swing training apparatus as recited in claim 15, and further including a ball flight tracking member, said ball flight tracking member being mounted to said ball retention apparatus, wherein said ball flight tracking member is configured to measure, record and transmit a launch angle and a spray angle of a baseball as the baseball departs the baseball swing training apparatus.

17. The baseball swing training apparatus as recited in claim 16, and further including a bat speed detection member, said bat speed detection member configured to measure, record and transmit a speed of a bat passing through the ball retention member.

18. The baseball swing training apparatus as recited in claim 17, wherein said first axis movement assembly is operable to provide adjustment of an explicit swing path loft angle, wherein said explicit swing path loft angle is a tilt in a swing plane of a bat from a perspective of a catcher to a pitcher of a baseball as viewed from a face-on bat direction.

19. The baseball swing training apparatus as recited in claim 18, wherein said second axis movement assembly is operable to provide adjustment of a horizontal swing path bat angle wherein the horizontal swing path bat angle is a horizontal angle of a bat traveling through a swing path.

20. The baseball swing training apparatus as recited in claim 19, wherein said third axis movement assembly being operable to provide adjustment of a vertical swing path angle wherein the vertical swing path angle is a vertical angle of a swing plane as viewed from center field of a baseball field.

* * * * *